United States Patent [19]

Bertsch

[11] 4,115,977

[45] Sep. 26, 1978

[54] METHOD OF ERECTING SWIMMING POOL STRUCTURE

[76] Inventor: Lyle E. Bertsch, 8207 Seiler, New Haven, Ind. 46774

[21] Appl. No.: 820,464

[22] Filed: Aug. 1, 1977

Related U.S. Application Data

[62] Division of Ser. No. 713,255, Aug. 10, 1976.

[51] Int. Cl.[2] ..... E04B 1/35

[52] U.S. Cl. ..... 52/742; 4/172.19; 52/169.7; 52/169.8

[58] Field of Search ..... 52/169.8, 169.7, 742, 52/169.1; 4/172.19, 172

[56] References Cited

U.S. PATENT DOCUMENTS

| | | | |
|---|---|---|---|
| 2,873,505 | 2/1959 | Sheldon | 52/169.7 X |
| 3,020,560 | 2/1962 | Bedick | 4/172.19 |
| 3,298,038 | 1/1967 | O'Connell et al. | 4/172.19 |
| 3,444,659 | 5/1969 | Shanni | 4/172.19 |
| 3,648,303 | 3/1972 | Stewart et al. | 4/172.19 |
| 3,798,857 | 3/1974 | Barrera | 52/169.8 |
| 3,820,174 | 6/1974 | Rozanski | 4/172.19 |
| 3,938,199 | 2/1976 | Laven | 4/172.19 |
| 3,975,477 | 8/1976 | Molitor | 52/742 |
| 3,975,874 | 8/1976 | Witte et al. | 4/172.19 |
| 4,015,379 | 4/1977 | Colson, Jr. | 52/169.8 |

FOREIGN PATENT DOCUMENTS

| | | | |
|---|---|---|---|
| 1,544,932 | 11/1967 | France | 52/169.8 |
| 1,290,823 | 9/1972 | United Kingdom | 52/169.7 |

*Primary Examiner*—Leslie Braun

[57] ABSTRACT

A method for erecting a swimming pool structure. The swimming pool structure includes wall sections, braces therefore, aligning stakes, and fasteners all of a non-corrosive material which when assembled eliminates the disadvantages normally associated with conventional assemblies using nut and bolt fasteners. The method preparing a swimming pool bottom, securing a plurality of wall sections together, attaching a plurality of braces having integral stake guides to the wall sections at spaced intervals, placing stakes in the stake guides, properly positioning the wall sections as desired with regard to the pool bottom, driving the stakes into the ground, aligning the wall sections with regard to both altitude and attitude, and securing the stakes to the braces. The wall sections and braces of the pool structure also provide support for the coping and deck of the completed swimming pool.

16 Claims, 9 Drawing Figures

METHOD OF ERECTING SWIMMING POOL STRUCTURE

CROSS REFERENCE TO THE EARLIER FILED APPLICATION

The application is a Division of application Ser. No. 713,255 filed Aug. 10, 1976.

BACKGROUND OF THE INVENTION

1. Field of the Invention

The invention relates to swimming pools, and more particularly to an improved method of erecting a swimming pool.

2. DESCRIPTION OF THE PRIOR ART

The prior art discloses several swimming pool structures and methods of erecting swimming pool structures. Some below-ground swimming pools are essentially poured concrete which tend to be very expensive. Other aboveground and below-ground swimming pool structures comprise wall sections made of metal or glass fiber reinforced plastic materials. While these pool structures are less expensive than poured concrete pool structures, all such structures conventionally have used metal fasteners, i.e. nuts and bolts, for fastening the wall sections together and metal members for supporting and securing the pool wall in position. All of these metal parts are subject to corrosion. The weakest link in conventional pools are these metal elements; these metal elements eventually may cause the pool structure to fail.

The erection of a below-ground swimming pool has also been relatively complex. Once the excavation is completed, forms must be positioned for pouring a concrete pool. The side wall erection of those pools comprising wall sections includes connecting the panels together which is traditionally done by hand, using nuts and bolts and conventional wrenches, positioning and securing the pool sections in proper position which includes both correctly positioning the wall sections relative to the pool bottom and positioning the wall sections both with regard to the proper altitude relative to the grade at the top of the pool and attitude relative to the vertical. Conventionally stakes, rods, bricks and blocks and both interior and exterior bracing are necessary to hold the pool walls in position while pouring the pool bottom, back filling between the excavation and the pool wall, and pouring the coping and deck. Such an erection process is exacting, time consuming and requires considerable labor, both skilled and unskilled, besides a great number of stakes and a considerable amount of lumber for bracing.

Conventionally, above-ground and below-ground swimming pools are of an entirely different nature. The provision of a pool structure which can be erected both above and below ground gives pool manufacturers new versatility, possibility resulting in increased volume and lower manufacturing costs.

It is therefore desirable to provide an improved swimming pool structure which can be both used above and below ground. It is desirable to provide an improved swimming pool structure which completely eliminates all elements which are susceptible to rust, corrosion, or rot. It is desirable to provide a swimming pool structure that can be more easily erected. It is also desirable to provide a swimming pool structure which can be sold as a kit which includes essentially all of the materials necessary to erect the pool. It is further desirable to provide a swimming pool structure and method of erecting the same which minimizes the time and labor required to erect the pool. It is finally desirable to provide such a swimming pool structure which can be manufactured and sold competitively with pools of conventional structure.

SUMMARY OF THE INVENTION

It is therefore a primary object of this invention to provide an improved method of erecting a swimming pool structure.

It is another object of the invention to provide an improved method of erecting a swimming pool which is applicable to both above or below ground structures.

It is another object of the invention to provide an improved method of erecting a below-ground swimming pool structure the wall sections of which can be properly positioned and secured for backfilling, and pouring the bottom, the coping, and the deck in a fraction of the time required by conventional methods.

It is still further an object of this invention to provide an improved method of erecting a pool structure fulfilling all of the objects mentioned hereinabove.

In the broader aspects of this invention there is provided a method for erecting a swimming pool structure either above or below ground level. This method includes preparing a swimming pool bottom, securing a plurality of wall sections together, attaching a plurality of braces having integral stake guides to the wall sections at spaced intervals, placing stakes in the stake guides, properly positioning the wall sections as desired with regard to the bottom of the pool, driving the stakes into the ground, positioning the wall sections with regard to both altitude and attitude and securing the stakes to the braces. The wall sections and braces of the pool structure also provide support for the coping and deck of the completed swimming pool.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings wherein.

DESCRIPTION OF A SPECIFIC EMBODIMENT

Figure 1:
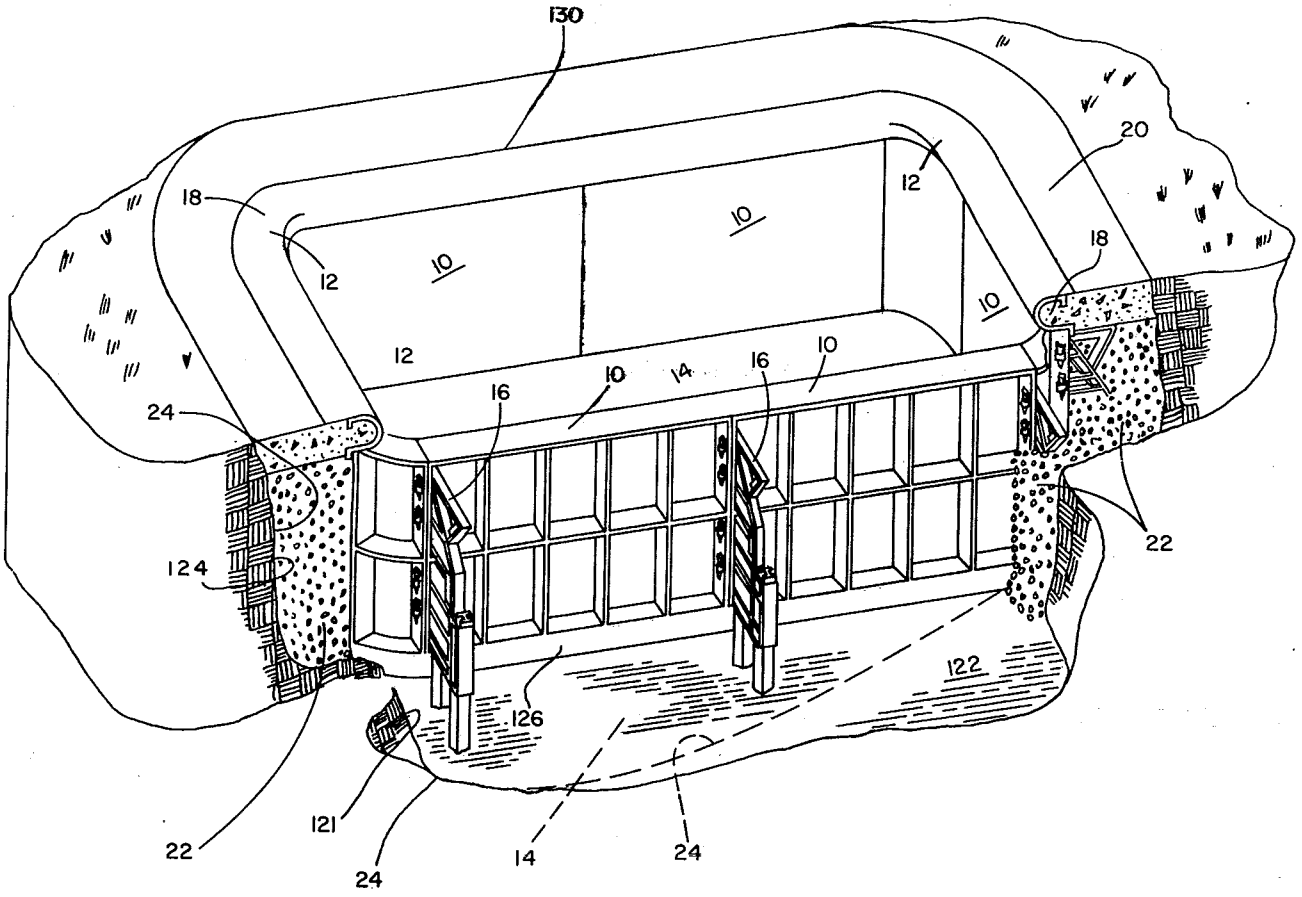
FIG. 1 is a perspective and broken away view of the swimming pool structure of the invention, showing the wall sections, the braces supporting the same, the excavation, the pool bottom, the back fill between the wall sections and the excavation, the coping and the deck.

Referring now to FIG. 1, there is shown the improved swimming pool structure of the invention mounted in the ground. The swimming pool structure includes the side wall sections 10 and corner wall sections 12, a pool bottom 14, a plurality of braces 16 supporting the wall sections 10, 12, back fill 22 around the braces and between the excavation 24 and pool walls 10, 12, coping 18 and a deck 20.

Referring now to FIGS. 2, 4, 5, and 7, brace 16 of the invention will be described in detail. Brace 16 has a body 26, a deck and coping support 28, connectors 30 and stake guides 32, 33.

The coping and deck support 28 has an upwardly facing surface 34 on which both the coping 18 and the deck 20 rest. Surface 34 defines the top of the brace 16. The deck and coping support 28 is connected to the body 26 by suitable bracing 36.

The connectors 30 protrude from the front surface 38 of the body 26. Each of the connectors 30 are identical, and thus, the description of one will suffice for the description of all. Secured to each brace 16, in the specific embodiment illustrated, are four connectors 30. Connectors 30 are secured to the body 26 in a spacedapart relation, there being one connector 30 adjacent the surface 34 and one connector 30 adjacent the bottom surface 40 of body 26. The other two connectors are positioned between the top most and bottom most connectors 30; the connectors 30 are generally equally spaced from each other.

Figure 2:
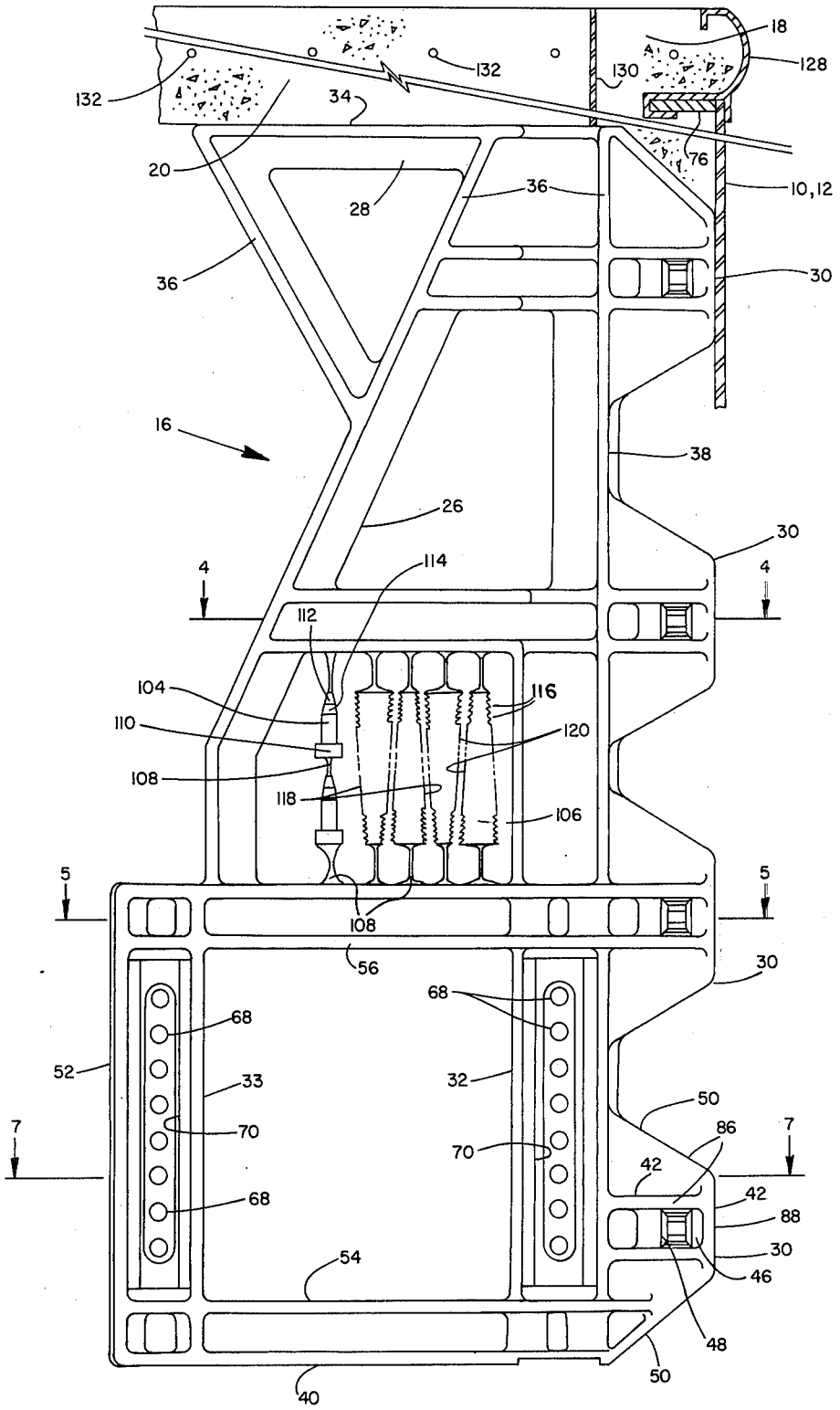
FIG. 2 is a side view of the improved wall brace of the swimming pool structure of the invention including the stake fastening and wall section securing means attached thereto showing a wall section, the coping and deck in cross-section.
Figure 4:
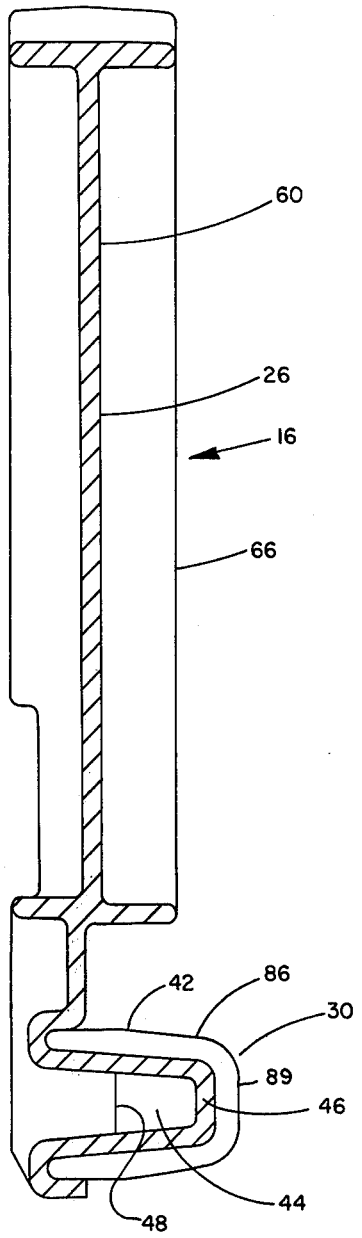
FIG. 4 is a sectional view of the brace illustrated in FIG. 2 taken substantially along the section line 4—4.
Figure 5:
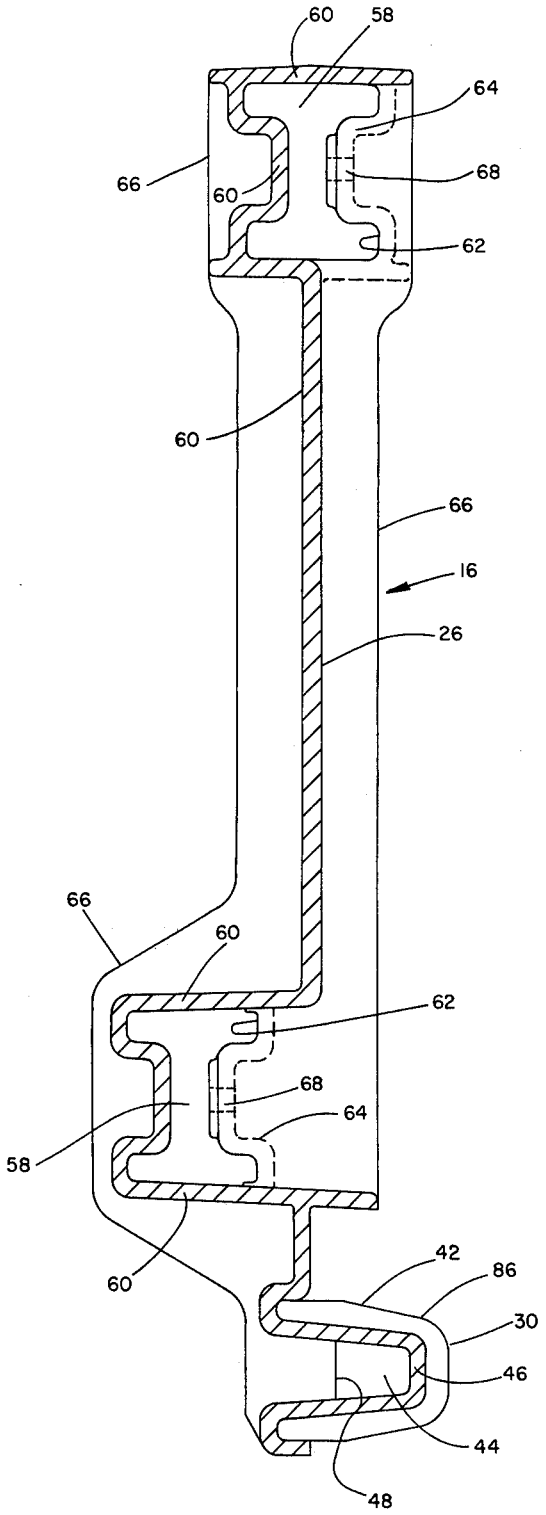
FIG. 5 is a sectional view of the brace illustrated in FIG. 2 taken substantially along the section line 5—5.
Figure 7:
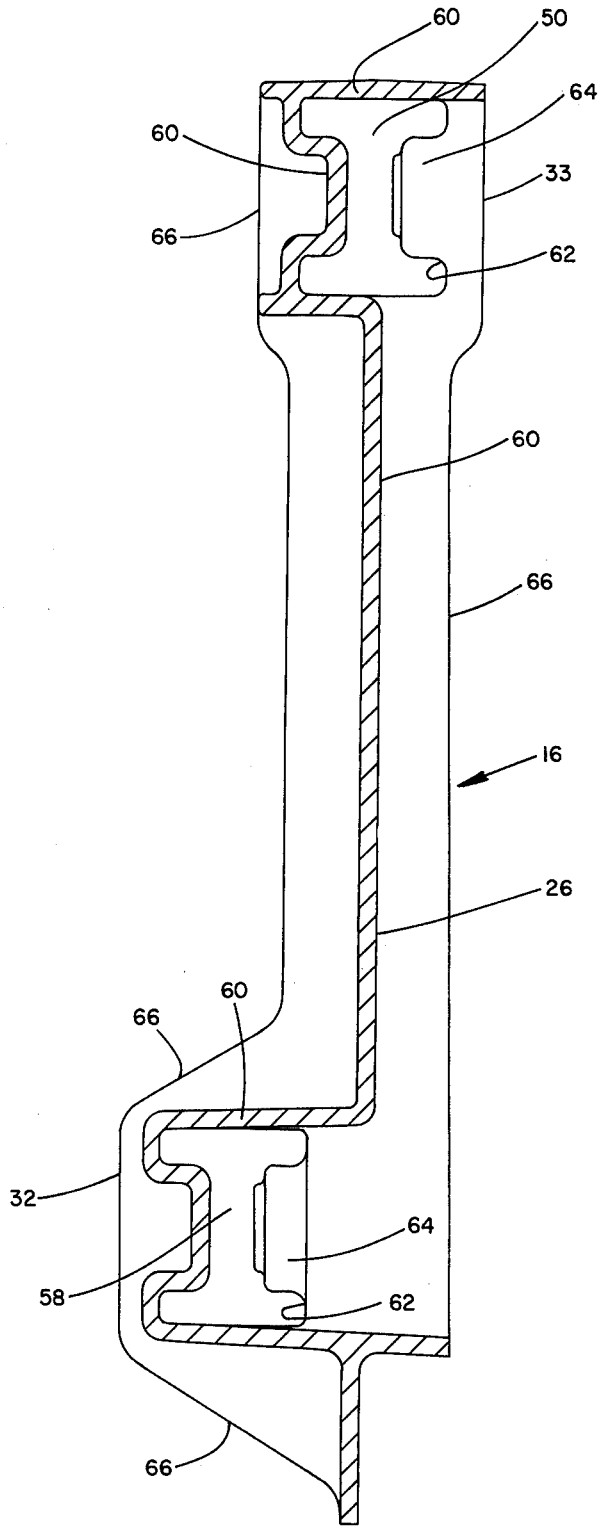
FIG. 7 is a sectional view of the brace illustrated in FIG. 2 taken substantially along the section line 7—7.

As shown in FIGS. 4, 5, and 7, each of the connectors 30 protrude from the body 26 to one side thereof. Each of the connectors 30 comprise a flange 42 which generally defines the shape of the connector 30. Each connector 30 has an aperture 44 therein generally defined by a web 46 and a planar body surface 48. As shown in FIG. 2, the connectors 30 are secured to the body 26 by suitable bracing 50.

Stake guides 32, 33 are positioned adjacent the bottom 40 of the body 26. Stake guide 32 is positioned adjacent the lower two connectors 30. Stake guide 33 is spaced from stake guide 32 and defines the rear 52 of the body 26. Extending between stake guides 32 and 33 are body members 54 and 56. Body member 54 is positioned adjacent the bottom of brace 16; bottom surface 40 is the bottom surface of member 54. Member 56 is positioned adjacent the top of the stake guides 32, 33 and is shown to extend rearwardly from the lower of the intermediate connectors 30. As shown in FIGS. 5 and 7, stake guide 32 extends from body 26 in the opposite direction as connectors 30. In contrast, stake guide 33 is positioned generally on the center line of the brace 16.

Both of the stake guides 32 and 33 have an opening 58 therein which generally conforms to the shape of the stakes. Openings 58 are generally defined by a web 60 a body surface 62 and a boss 64 which extends from body surface 62 over an appreciable length of the stake guides 32, 33. Surrounding the webs 60 is a flange 66 which defines the general exterior shape of the stake guides 32, 33.

As above mentioned, boss 64 extends from the body surface 62 substantially over the length of the stake guides 32, 33. FIG. 2 shows a side plan view of the boss 64. Extending through the boss 64 are a plurality of spaced-apart openings 68. The uppermost opening 68 is adjacent member 56 and the bottom most opening 68 is adjacent member 54. As best shown in FIG. 2, an opening 70 is formed in the web 60 so as to expose the boss 64 and the openings 68 as viewed in FIG. 2. The openings 68 extend entirely through the boss 64.

As illustrated in FIGS. 2, 4, 5, 6, and 7, each of the structural elements above-mentioned, in the specific embodiment illustrated is integrally formed of a flange and web structure similar to conventional structural members having "I", "T", or the like cross-sectional shapes. The specific brace 16 illustrated can be totally integrally formed by molding utilizing conventional techniques.

Figure 3:
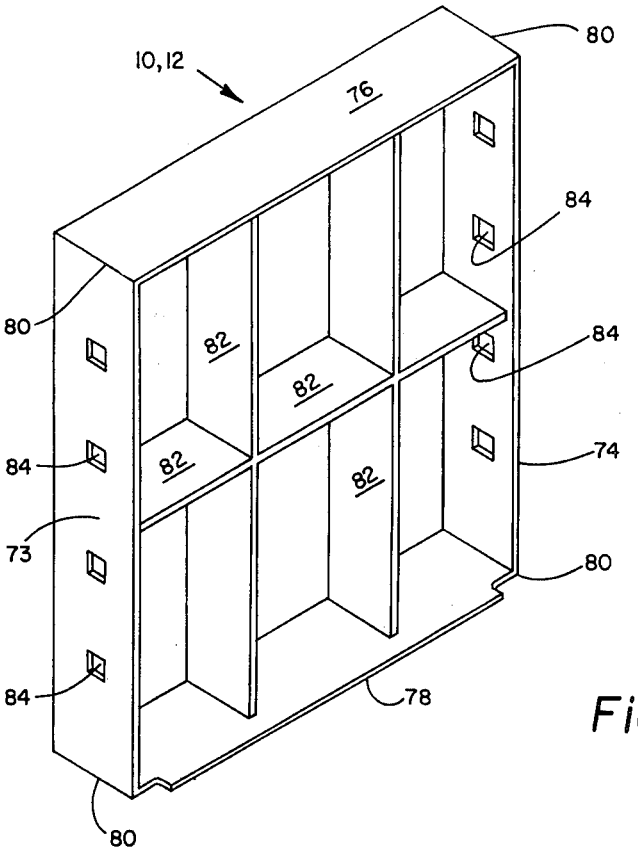
FIG. 3 is a perspective view of a wall section of the improved swimming pool structure of the invention.

Now referring to FIG. 3, the wall sections 10, 12 will be described. Each of these wall sections have a front surface 72 which, as will be explained hereinafter, defines the interior pool surface together with the bottom 14. Each of the wall sections 10, 12 also have opposite end flanges 73 and 74 and top and bottom flanges 76 and 78. Flanges 73 through 78 each extend rearwardly of the surface 72 and are connected together at the corners 80. Suitable bracing 82 is provided to extend between flanges 73 through 78 to give the wall sections 10, 12 suitable strength and rigidity. End flanges 73, 74 each have a plurality of spaced-apart openings 84 therein. Openings 84 are sized and shaped generally to conform with the size and shape of the connectors 30 as defined by the flange 42 and the bracing 50. It should be noted that the exterior surface 86 of the flanges 42 and bracing 50 are each tapered toward the distal end 89 of the connector 30 so as to provide a "tight" fit when the connectors 30 are positioned within the holes 84.

The surface 72 of each of the wall sections 10 is generally planar. Flanges 73 through 78 and bracing 82 all extend rearwardly of the surface 72 generally perpendicularly thereof. In contrast, the surface 72 of each of the corner wall sections 12 is generally cylindrical, being radiused about an axis extending generally perpendicularly of the planes which flanges 76 and 78 define. End flanges 73, 74 and the bracing 82 which extend between top and bottom flanges 76 and 78 extend rearwardly of the surface 72 generally radially thereof. Each of the top and bottom flanges 76, 78 and the bracing 82 generally parallel thereto are part annular. Otherwise, wall sections 10, 12 are identical. In the specific embodiment illustrated in FIG. 3, entire wall sections 10, 12 can be molded as a single piece with the flanges 73 through 78 and the bracing 82 all integral. In preferred embodiments, an aesthetically pleasing design can be placed in the surface 72 and the entire wall sections 10, 12 can be molded of the same material as braces 16.

Figure 8:
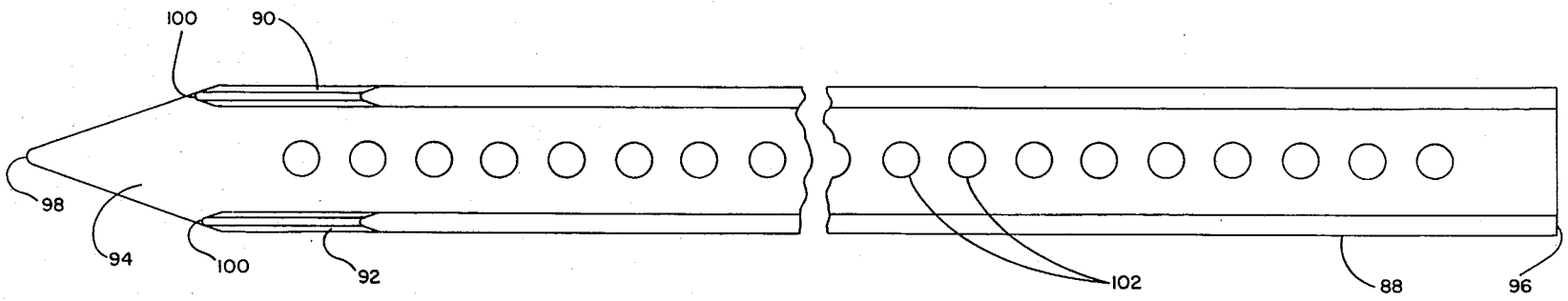
FIG. 8 is a broken side view of the stake of the improved swimming pool structure of the invention.
Figure 9:
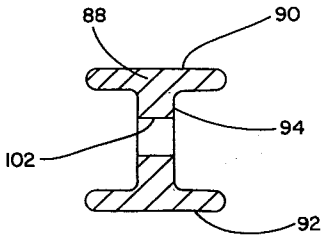
FIG. 9 is a sectional view of the stake illustrated in FIG. 8 taken substantially along the section line 9—9.

FIGS. 8 and 9 illustrate the stakes 88 of the invention. Stakes 88 as shown in FIG. 9 have a cross-sectional shape geometrically similar to the opening 58 in the stake guides 32, 33. Specifically, each of the stakes 88 includes opposite flange portions 90, 92 and an intermediate web portion 94. Web portion 94 extends the entire length of the stake 88 from the head 96 to the point 98. As shown in FIG. 8, the point 98 is essentially formed of the web 94 inasmuch as the flanges 90, 92 terminate at a position 100 spaced from the point 98. Positioned in the center of the web 94 are a plurality of openings 102. Openings 102 are spacedapart and aligned on the center line of the stake 88. The uppermost opening 102 is adjacent the head 96 and the lower most opening 102 is adjacent the point 98.

By comparing FIG. 9 with FIGS. 4, 5, and 7, it will be readily seen that the cross-sectional shape of the stake 88 between the head 96 and the end of the flanges 90, 92 is essentially the same as the cross-sectional shape of the opening 58 of stake guides 32, 33 such that stakes 88 can be slidably positioned within the openings 58 of stake guides 32, 33 and held against rotation, as will be explained hereinafter. The particular spacing of the openings 102 and the spacing of the openings 68 in the boss 64 of the stake guides 32, 33 are chosen such that at least one opening 102 and one opening 68 are positioned coaxially in each position the stake 88 might be desirably secured within the stake guides 32, 33. In a specific embodiment, the spacing of the openings 68, 102 are chosen such that each fraction of an inch that the stake 88 is moved within the stake guides 32, 33 different pairs of openings 68, 102 become coaxial. In a preferred embodiment, different pairs of openings 68, 102 become coaxial each one quarter inch that the stake 88 is moved within the stake guides 32, 33.

In the specific embodiment illustrated, stake 88 is again formed so as to have the cross-sectional shape of a conventional "I" beam. As illustrated in drawing, the stake 88 can be molded from the same material as the wall sections 10, 12 and the braces 16 are made.

As will be mentioned hereinafter, the swimming pool structure of the invention also includes a plurality of pins 104 and a plurality of wedges 106. Pins and wedges 104 and 106 can be molded integral with the brace 16 and connected thereto by break away portions 108. Thus, pins and wedges 104 and 106 are shown in FIG. 2. Each of the pins 106 has circular transverse cross-sections and includes a head 110 a tip 112 and a detent 114. Each of the wedges 104 has a plurality of teeth 116 covering the opposite sides 118, 120 thereof. Both pins 104 and wedges 106 are shown in cross-section in FIG. 6.

In a preferred embodiment, the wall sections 10, 12, the braces 16, the stakes 88, the pins 104, the wedges or pegs 106, can all be molded, as illustrated, from structural foam. Conventionally, the pool bottom 14, the coping 18 and the deck 20 are all constructed of concrete. The back fill 22 is generally gravel or sand or the like.

Referring now to FIG. 1, the method of erecting the swimming pool structure of the invention below ground will now be described. Once the site of the swimming pool is properly located, a hole 24 is excavated in the ground having a bottom with upstanding sides 121 shaped to geometrically conform to the shape of the bottom of the swimming pool. This bottom and upstanding sides 121 of the excavation or hole will form the exterior surface of the bottom 14 of the swimming pool, as will be explained hereinafter.

At the top of the upstanding sides 121 of the bottom of the excavation 24 and spaced from the ground surface there will be formed a lip 122 which will extend generally horizontally outwardly from the upstanding bottom sides 121 of the excavation 24 all around the pool. The width of lip 122 can vary but in general should be sufficiently larger than the longitudinal dimension of the brace 16 as shown in FIG. 5 to allow workmen to connect the braces 16 to the wall sections 10, 12 and to position and secure the stakes 88 thereto, as will be described hereinafter. Upstanding from the lip 122 is a excavation side 124 which basically defines the width of the lip 122. Side 124 extends from ground level to the lip 122; whereas the upstanding bottom wall 121 extends generally downwardly from the lip 122. Care must be taken that the upwardly facing surface of the lip 122 is generally parallel with the ground level and is located at the proper dimension from ground level, as will become more apparent from the description hereinbelow.

Once the excavation 24 is completed and is generally properly dimensioned and shaped, a plurality of wall sections 10, 12 are arranged on the lip 122. It should be understood that the edge of the lip 122 will generally conform to the exterior surface of the pool bottom 14.

Figure 6:
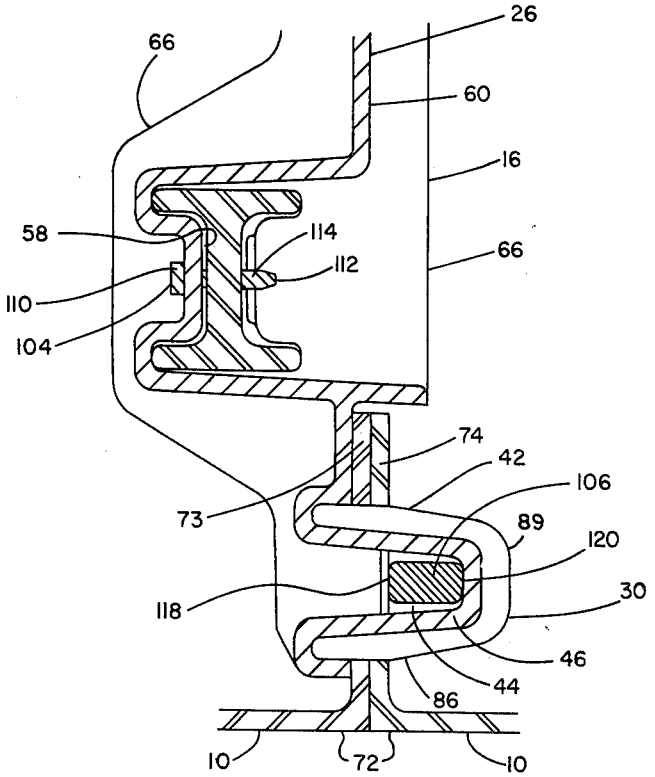
FIG. 6 is a fragmentary view like FIG. 5 showing the wall section stake and brace structure of the invention in an assembled condition.

Pool sections 10, 12 are now assembled together. This is done by placing each of the sections 10, 12 in end to end relation with the end flange 73 of one section in abutment with the end flange 74 of the adjacent wall section. A brace 16 is positioned as shown in FIG. 1 with regard to each of the abutted flanges 73, 74. In this position, the connectors 30 are each positioned within the openings 84 of the abutted end flanges 73, 74 as shown in FIG. 6. When the wall sections 10, 12 are properly positioned in the aforedescribed end to end relation with the flanges 73, 74 adjacent wall sections in abutment, the surfaces 72 of adjacent wall sections and the top flanges 76 and the bottom flanges 78 should all define generally continuous exterior surfaces. In this position, the openings 84 in the end flanges 73 and 74 mate and are coaxial. Further, the openings 84 being both sized and shaped alike, connectors 30 can be easily positioned therein.

The pegs 106 are removed from braces 16, by removing the break aways 108, (see FIG. 2) and are positioned in the openings 44 of the connectors 30 and wedged therein. The teeth 116 of the wedges 106 engage the flanges 73, 74 and the web 46 so as to prevent their unintentional removal. By this means, the flanges 73 and 74 are wedged together tightly and the braces 16 are connected to the wall sections 10, 12. The connected together wall sections 10, 12 are positioned such that the surfaces 72 are positioned so as to define the pool interior surface and the stakes 88 are positioned within the stake guides 32, 33 and driven into the lip 122. The stakes 88 will support the wall sections 10, 12 in position and hold the wall sections 10, 12 in alignment with the proposed pool interior.

As soon as all of the braces 16 are so connected and all of the stakes 88 are driven into the lip 122, the interior shape of the swimming pool will be accurately defined by the lower portion of the continuous surface defined by the individual surfaces 72 of the wall sections 10, 12 and each of the wall sections 10, 12 will be resting on the lip 122. However, inasmuch as each of the stakes 88 are slidably positioned within the stake guides 32, 33 of braces 16, each of the wall sections 10, 12 can be raised in position and tilted forwardly and rearwardly of the surfaces 72 on both sides of the vertical.

Each of the wall sections next must be adjusted as to grade and the vertical. This is achieved by raising each of the wall sections 10, 12 by slidably moving the braces 16 with respect to the fixed stakes 88. As each wall section is positioned correctly in respect to grade and the vertical, the pins 104 are removed from their position in the brace 16 as shown in FIG. 2 by removing the break aways 108 and driven into the appropriate pair of openings 68, 102 which are coaxial in the proper position. This adjustment as to altitude and attitude of each of the wall sections 10, 12 is made all around the periphery of the pool. Once the pins 104 are driven into the appropriat pair of openings 68, 102, the detents 114 prevent their unintentional removal.

Once this procedure is completed, the wall sections 10, 12 are each positioned exactly where desired with regard to the interior of the pool, the grade level, and the vertical, and are held sturdily in position by the braces 16. The pool structure is now ready for the pouring of the bottom 24 or sanding as desired. The bottom is poured or sanded in a conventional manner to include a footing 126 which surrounds the bottom flange 78 of the wall sections 10, 12 as shown in FIG. 1.

Once the bottom 24 and the footing 126 has been poured, the back fill 22 can be placed in position between the wall sections 10, 12 and the upstanding hole walls 124 as shown in FIG. 1. The back fill 22 in a preferred embodiment is gravel. The top of the back fill 22 is leveled to generally coincide with the plane defined by the surfaces 34 of the coping and deck supports 28 of the braces 16. Once the back fill 22 is properly positioned, and the desired coping facing 128 is attached to the top flange 76 of the wall sections 10, 12 (see FIG. 2), the coping 18 can be poured. Sequentially following the pouring of the coping 18 is the pouring of the deck 20. Conventionally an expansion joint 130 is positioned between the coping 18 and the deck 20. Suitable reinforcing rods 132 can be positioned within both the coping 18 and the deck 20 as desired.

The method of erecting the swimming pool structure of the invention above the ground is similar to the method of erecting the swimming pool structure of the invention below the ground as above-described. Once the site of the swimming pool is properly located, the ground which will serve as the pool bottom is properly prepared and shaped. Surrounding the pool bottom, an annular lip 122 is prepared which will support the pool wall sections 10, 12 and the braces 16. Annular lip 122 is desirably shaped to be generally horizontal and planar at an altitude slightly below the anticipated altitude of the pool bottom to provide a proper connection between the pool bottom and the wall sections. To achieve this result, the pool bottom and the lip can be initially formed in the same plane and the pool bottom raised in elevation by sanding or the like subsequent to the installation of the wall sections 10, 12.

The erection of the pool wall sections 10, 12 on the lip 122 is accomplished in the same manner as above mentioned. The pool sections are first arranged on the lip 122 and the pool sections 10, 12 are assembled together and to the braces 16. The wall sections 10, 12 are positioned such that the surfaces 72 define the interior surface of the pool and the stakes 88 are positioned within the stake guides 32, 33 and driven into the lip 122. No additional support is required for the pool walls other than the braces 16 and the stakes 88. As soon as all of the braces 16 are connected to the wall sections 10, 12 and all of the stakes 88 are driven into the lip 122, the wall sections are each adjusted as to altitude and attitude, and the stakes are secured to the braces 16 as above described.

Once this procedure and the above-mentioned connection between the pool bottom and the wall sections 10, 12 is completed, the pool structure is completed and may be lined with a conventional liner, filled with water and used. If desired, a deck can be constructed of redwood or the like and supported on the coping and deck supports 28 of the braces 16.

The improved swimming pool structure of the invention and the method of erecting the same fills a long felt need in the swimming pool industry. All of the structure can be made of a non-corrosive material, thus providing a completely non-corrosive pool structure. The pool wall and supporting structure facilitates the erection thereof and eliminates conventional staking and bracing. By the improved wall and bracing structure, the wall sections can be correctly positioned to define the interior pool wall surface, adjusted in altitude and attitude, and secured in place all in a fraction of the time heretofore required with conventional pool structures. The improved pool structure can be manufactured and sold, as a kit requiring less additional materials to erect in conventional pool structures or otherwise, at prices competitive with conventional pool structures. The improved method of erecting the pool structure of the invention requires less time, less labor, and less materials than conventional pools. The cost of erecting the improved pool structure of the invention thus, is less costly than heretofore possible, and due to the improved pool structure and the non-corrosive features thereof, such pools should last longer than conventional pool structures.

While there have been described above the principles of this invention in connection with specific apparatus, it is to be clearly understood that this description is made only by way of example and not as a limitation to the scope of the invention.

What is claimed is:

1. A method of erecting a swimming pool comprising the steps of preparing the ground for a swimming pool bottom and to provide a lip extending generally horizontally outwardly from said pool bottom, placing a plurality of wall sections on said lip, securing said wall sections together so as to form a generally continuous interior wall surface conforming shape to the interior wall of said pool, attaching braces to said wall sections at spaced intervals, said braces extending rearwardly of said wall sections, each of said braces having a pair of stake guides, one of said stake guides being adjacent to said wall sections, the other stake guides being remote from said wall sections, placing stakes in said guides, positioning the bottoms of said wall sections as desired, driving said adjacent stakes into said lip, holding said wall sections so as to position said wall surface generally vertical, driving said remote stakes into said lip, lifting said wall sections to a desired height, adjusting said wall sections a desired attitude relative to said vertical, and fastening said stakes and braces together.

2. The method of claim 1 wherein said securing and attaching steps includes providing each of said wall sections with flanges at the opposite ends thereof, placing said wall sections in end to end relation, abutting said end flanges of adjacent wall sections together, providing each of said abutted end flanges with a plurality of openings therein, providing each of said braces with a connector for each of said openings, said connectors extending from each brace and having an aperture therein, positioning said connectors of each of said braces in the openings of one pair of abutted end flanges, and positioning a wedge in each of said apertures, thereby wedging each pair between a brace and the wedges positioned in the connector apertures thereof.

3. The method of claim 1 wherein said fastening step includes providing each of said stake guides with a plurality of spaced openings therein, providing each of said stakes with a plurality of apertures therein, one of said apertures and one of said openings corresponding to a different position of said stake in said stake guide, and placing a pin in said desired aperture and opening pair.

4. The method of claim 1 wherein said lifting and fastening steps include fastening said adjacent stakes to said braces to position said wall sections at the desired altitude, and fastening said remote stakes to said braces to position said wall surface in the desired vertical attitude.

5. The method of claim 2 wherein said fastening step includes providing each of said stake guides with a plurality of spaced openings therein, providing each of said stakes with a plurality of apertures therein, one of said apertures and one of said openings corresponding to a different position of said stake in said stake guide, placing a pin in said desired aperture and opening pair, said wedges and pins used with one of said braces are removably attached to said one brace, and said securing and fastening steps include the step of removing said wedges and pins from said brace.

6. The method of claim 1 wherein said preparing step includes excavating a hole in the ground, and further comprising the step back filling between said wall portions and wall sections.

7. The method of claim 6 further comprising the steps of laying both coping and deck on said braces, said braces partially supporting said coping and deck.

8. The method of claim 7 wherein said securing and attaching steps includes providing each of said wall sections with flanges at the opposite ends thereof, placing said wall sections in end to end relation, abutting said end flanges of adjacent wall sections together, providing each of said abutted end flanges with a plurality of openings therein, providing each of said braces with a connector for each of said openings, said connectors extending from each brace and having an aperture therein, positioning said connectors of each of said braces in the openings of one pair of abutted end flanges, and positioning a wedge in each of said apertures, thereby wedging each pair between a brace and the wedges positioned in the connector apertures thereof, said fastening step includes providing each of said stake guides with a plurality of spaced openings therein, providing each of said stakes with a plurality of stake apertures therein, one of said stake apertures and one of said openings corresponding to a different position of said stake in said stake guide, and placing a pin in said desired stake aperture and opening pair, said lifting and fastening steps include fastening said adjacent stakes to said braces to position said wall sections at desired altitude, and fastening said remote stakes to said braces to position said wall surface in the desired vertical attitude, said wedges and pins used with one of said braces are removably attached to said one brace, and said securing and fastening steps include the step of removing said wedges and pins from said brace.

9. The method of claim 8 further comprising the steps of forming said bottom in said hole, said bottom extending downwardly from adjacent said lip.

10. The method of claim 1 further comprising the step of forming said bottom so as to overlay a bottom portion of said wall sections.

11. The method of claim 1 further comprising the step of lining said pool with a liner so as to cover said bottom and said wall sections.

12. The method of claim 1 wherein said preparing step includes shaping the ground so that the top of said bottom is adjacent said lip.

13. The method of claim 12 further comprising the steps of laying a deck on said braces, said braces partially supporting said deck.

14. The method of claim 13 wherein said lip is generally at ground level, said wall sections and braces extending above ground level.

15. The method of claim 14 wherein said securing and attaching steps includes providing each of said wall sections with flanges at the opposite ends thereof, placing said wall sections in end to end relation, abutting said end flanges of adjacent wall sections together, providing each of said abutted end flanges with a plurality of openings therein, providing each of said braces with a connector for each of said openings, said connectors extending from each brace and having an aperture therein, positioning said connectors of each of said braces in the openings of one pair of abutted end flanges, and positioning a wedge in each of said apertures, thereby wedging each pair between a brace and the wedges positioned in the connector apertures thereof, said fastening step includes providing each of said stake guides with a plurality of spaced openings therein, providing each of said stakes with a plurality of stakes therein, one of said stake apertures and one of said openings corresponding to a different position of said stake in said stake guide, and placing a pin in said desired stake aperture and opening pair, said lifting and fastening steps include fastening said adjacent stakes to said braces to position said wall sections at desired altitude, and fastening said remote stakes to said braces to position said wall surface in the desired vertical attitude, said wedges and pins used with one of said braces are removably attached to said one brace, and said securing and fastening steps include the step of removing said wedges and pins from said brace.

16. The method of claim 15 wherein the bottom of said pool is adjacent ground level.

* * * * *

UNITED STATES PATENT OFFICE

CERTIFICATE OF CORRECTION

Patent No. 4,115,977 Dated September 26, 1978

Inventor(s) Lyle E. Bertsch

It is certified that error appears in the above-identified patent and that said Letters Patent are hereby corrected as shown below:

Column 1, Line 20 between "Other" and "and" the word "aboveground" should read "above-ground".

Column 3, Line 27 between "a" and "relation" the word "spacedapart" should read "spaced-apart".

Column 4, Line 65 between "are" and "and" the word "spacedapart" should read "spaced-apart".

Column 6, Line 21 between "the" and "end" the word "aforedescribed" should read "afore-described".

Column 7, Line 1 between "the" and "pair" the word "appropriat" should read "appropriate".

UNITED STATES PATENT OFFICE

CERTIFICATE OF CORRECTION

Patent No. 4,115,977 Dated September 26, 1978

Inventor(s) Lyle E. Bertsch

It is certified that error appears in the above-identified patent and that said Letters Patent are hereby corrected as shown below:

Column 5, Line 29 between "molded" and "with" the word "integral" should read "integrally".

Column 5, Line 33 between "head 110" and "a tip" insert a comma "--,--".

Signed and Sealed this

*Twenty-third* Day of *December 1980*

[SEAL]

*Attest:*

SIDNEY A. DIAMOND

*Attesting Officer*

*Commissioner of Patents and Trademarks*